US011651634B1

(12) United States Patent
Dudar

(10) Patent No.: US 11,651,634 B1
(45) Date of Patent: May 16, 2023

(54) SYSTEM AND METHOD FOR DIAGNOSING A VARIABLE OIL PUMP

(71) Applicant: Ford Global Technologies, LLC, Dearborn, MI (US)

(72) Inventor: Aed Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/645,649

(22) Filed: Dec. 22, 2021

(51) Int. Cl.

| | |
|---|---|
| ***G07C 5/08*** | (2006.01) |
| ***F04B 51/00*** | (2006.01) |
| ***F02D 41/12*** | (2006.01) |
| ***F01M 1/02*** | (2006.01) |
| ***F02D 41/06*** | (2006.01) |
| ***F01M 1/18*** | (2006.01) |

(52) U.S. Cl.
CPC ..... *G07C 5/0808* (2013.01); *F01M 1/02* (2013.01); *F01M 1/18* (2013.01); *F02D 41/064* (2013.01); *F02D 41/12* (2013.01); *F04B 51/00* (2013.01); *F02D 2200/101* (2013.01)

(58) Field of Classification Search
CPC ..... G07C 5/0808; F01M 1/02; F01M 1/18; F02D 41/064; F02D 41/12; F02D 2200/101; F04B 51/00
See application file for complete search history.

(56) References Cited

U.S. PATENT DOCUMENTS

| | | | | |
|---|---|---|---|---|
| 10,927,726 | B2 | 2/2021 | Dudar | |
| 11,022,010 | B2 | 6/2021 | Dudar | |
| 2019/0120096 | A1* | 4/2019 | Dudar | F01M 1/18 |
| 2019/0195095 | A1* | 6/2019 | Dudar | B60W 10/30 |

FOREIGN PATENT DOCUMENTS

| | | | | |
|---|---|---|---|---|
| EP | E P-3783219 | A1 * | 2/2021 | F01M 1/08 |

OTHER PUBLICATIONS

English translation of EP-3783219-A1 (Year: 2021).*

* cited by examiner

*Primary Examiner* — Joseph J Dallo
(74) *Attorney, Agent, or Firm* — Vincent Mastrogiacomo; McCoy Russell LLP

(57) ABSTRACT

Methods and systems are provided for diagnosing degradation of a variable oil pump (VOP). In one example, a method may include during a deceleration fuel shut-off (DFSO) condition, diagnosing degradation of the VOP based on a rotational speed of the engine.

17 Claims, 6 Drawing Sheets

SYSTEM AND METHOD FOR DIAGNOSING A VARIABLE OIL PUMP

FIELD

The present description relates generally to methods and systems for diagnosing a variable oil pump in a vehicle.

BACKGROUND/SUMMARY

A variable oil pump (VOP) driven by a crankshaft may provide engine oil at a pressure optimized for efficient engine operation and increased fuel efficiency of a vehicle. The VOP may be driven at the speed of rotation of the crankshaft, and additionally an opening of the pump may be adjusted via a solenoid, to increase or decrease the volumetric oil displacement per revolution of the pump. For a fixed opening of the VOP, the volumetric displacement of oil may increase with increasing speed of crankshaft rotation. Conversely, for a fixed speed of crankshaft rotation, the volumetric displacement of oil per revolution may increasing with an increased opening of the VOP. The position of the VOP may be adjusted responsive to engine speed. At low engine speed, the VOP may be set in a high displacement mode for providing lubrication to the engine's moving parts. At high engine speed, as the rotation speed of the VOP increases with increased rotation speed of the crankshaft, the VOP may be set to a low displacement mode for reduced volumetric oil displacement per revolution of the pump. Degradation of the VOP may cause the pump to be stuck at one displacement position.

Degradation of the VOP may lead to either an increased level of oil to the engine (e.g., when the VOP is stuck in a high displacement mode), lowering engine fuel efficiency, or a decreased level of oil to the engine (e.g., when the VOP is stuck in a low displacement position), increasing engine wear due to reduced lubrication of the components therein. Degradation of the VOP may include determining pressure generated at the VOP based on measurements from an oil pressure sensor. However, a diagnosis based on oil pressure may lack robustness under some conditions due to frequent fluctuations in oil pressure responsive to engine and operating conditions of the vehicle, such as from increased heat rejected to an oil system of the engine during engine operation. Additionally, in some circumstances, the oil pressure sensor itself may be faulty.

Attempts have been made to diagnose possible degradation of the VOP without relying on oil pressure measurements. One example diagnostic is given by Dudar in U.S. Pat. No. 10,927,726. Therein, engine cranking, whereby an electrical current may be supplied (e.g., in response to a key-on event) to a starter motor to initiate spinning of the crankshaft to generate sufficient compression in at least one cylinder of the engine for successful ignition, may be initiated by a battery, and the current generated during the engine cranking may be compared to a baseline current that occurs during operation of the VOP without any degradation. During a situation in which the VOP is stuck in a low displacement mode, an insufficient volumetric flow of oil may be supplied to the engine, resulting in an increased level of friction in the engine. During the increased level of friction generated within the engine, an electric motor of the vehicle may draw a greater current to compensate for a greater level of resistance generated by the crankshaft during engine cranking, resulting in a higher-than-baseline level of current generated by the battery. By indicating a higher-than-baseline level of current generated during the diagnostic, in may be inferred that the VOP is stuck in a high displacement mode. However, the inventors herein have recognized potential issues with diagnosing function of the VOP based on current generated during engine cranking. As one example, the diagnostic of U.S. Pat. No. 10,927,726 may not be responsive to issues with the engine cranking mechanism. For example, in the case of a degraded electrical connection (e.g., a degraded alternator) in the engine and/or a degraded battery, the engine cranking mechanism of the engine may be compromised. Comparison of the current generated during engine cranking to the calibrated baseline current may then provide an inaccurate diagnosis of the VOP.

In one example, the issues described above may be addressed by a method for an engine, comprising: during a deceleration fuel shut-off (DFSO) condition, diagnosing a variable oil pump (VOP) to be stuck in a displacement mode based on a rotational speed of the engine. In this way, operation of the VOP may be diagnosed in a robust manner during engine operation, independent of multiple sources of heat rejection to the crankcase and engine cranking issues.

As one example, the condition of the VOP may be diagnosed during the DFSO condition upon entry conditions such as a higher-than-threshold level of engine oil, and a higher-than-threshold engine temperature, being satisfied. The diagnostic may then include performing a duty cycle of cycling the VOP between a high displacement mode and a low displacement mode, and comparing a profile of the rotation of the engine (RPM) during the duty cycle to a pre-calibrated baseline RPM profile of a working VOP at low RPM. When the VOP is functioning correctly, during switching from a low displacement mode to a high displacement mode, a dip in the RPM of the engine may be expected, as the high displacement mode may exert a greater load on the engine. During normal engine operation (e.g., not in a DFSO condition), a controller of the vehicle may compensate for RPM dips by for example adjusting an opening of an electronic throttle control (ETC) valve. However, during the DFSO condition, such changes in torque remain uncompensated, as the engine is spun unfueled and the vehicle is propelled solely by momentum. An indication of a dip in RPM of the vehicle during the diagnostic may indicate that the VOP is operating correctly; a lack of a dip in RPM may indicate that the VOP is stuck in a low displacement mode. Further, if the VOP is stuck in a high displacement mode, the engine may have an RPM lower than a threshold RPM, due to the increased load the high displacement mode exerts on the engine. Thus, by comparing the RPM of the engine during the DFSO condition to the baseline RPM profile, degradation of the VOP, with the VOP being stuck in either of a high displacement mode or a low displacement mode, may be detected.

In this way, by diagnosing operation of the VOP during the DFSO condition based on a measured RPM profile of the engine, degradation of the VOP may be robustly diagnosed, independently of temperature and pressure fluctuations within the engine. Additionally, by relying on passive measurements of engine RPM during the DFSO condition, the VOP may be diagnosed independently of any engine cranking issues, such as those which may arise from a defective battery and/or compromised electrical connections within the engine (e.g., from a degraded alternator). The technical effect of diagnosing VOP degradation based on an engine RPM profile during the DFSO condition is that torque compensation may not be provided during cycling from a low displacement mode to a high displacement mode, allowing identification of any measured RPM dip (or lack thereof)

to be directly attributable to function of the VOP. By timely detecting degradation of the VOP, suitable mitigating actions may be undertaken to maintain desired engine performance.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
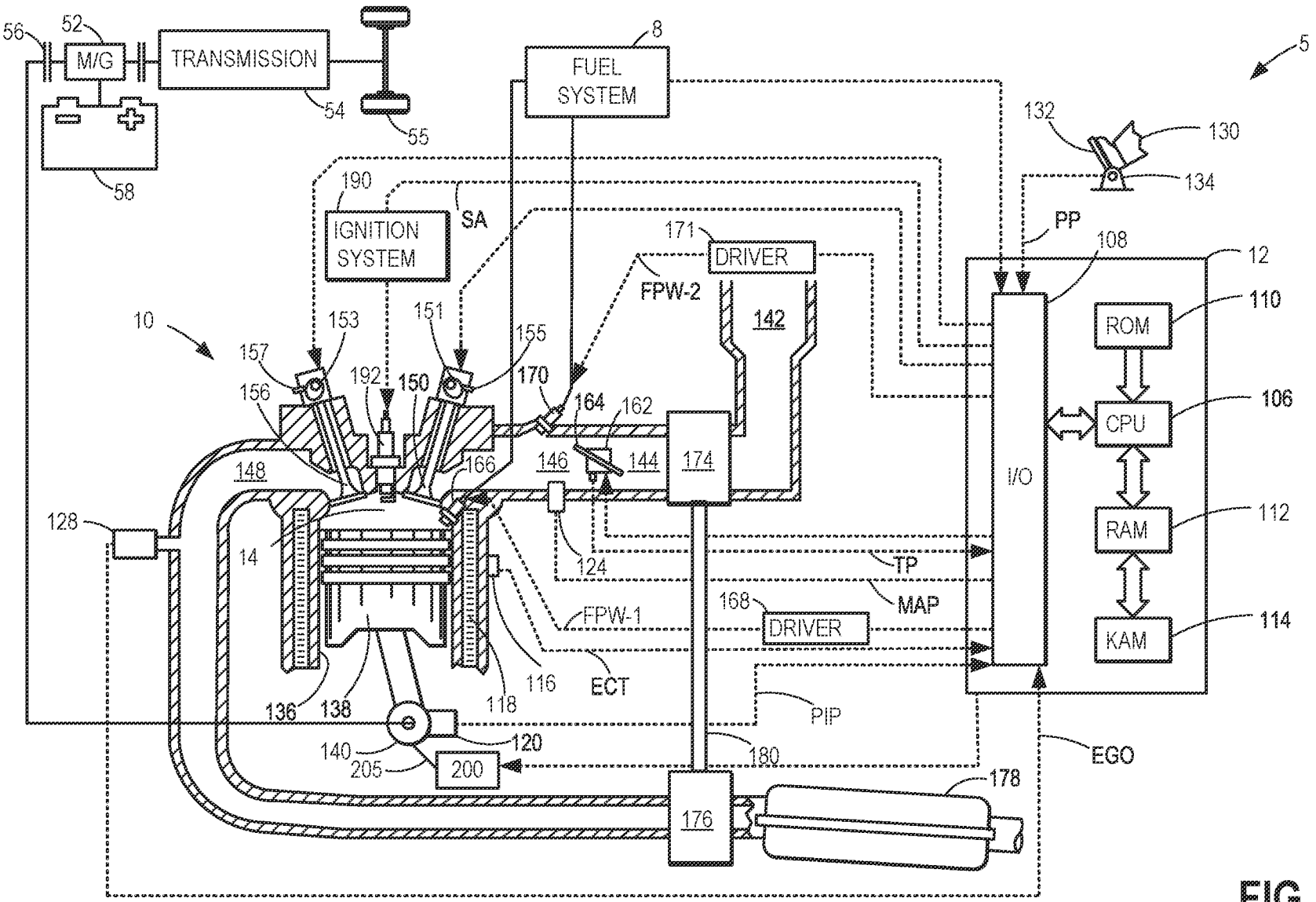
FIG. 1 shows a diagram of an example embodiment of an engine system of a vehicle.
Figure 3B:
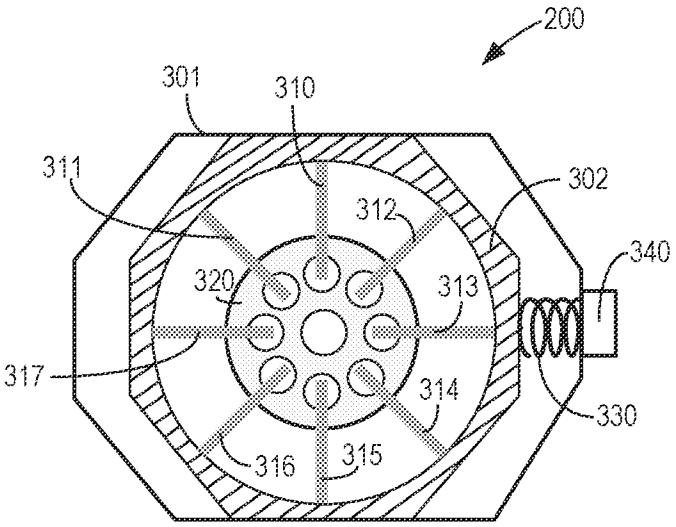
FIG. 3B shows the example VOP of FIG. 3A in a low displacement mode.
Figure 3A:
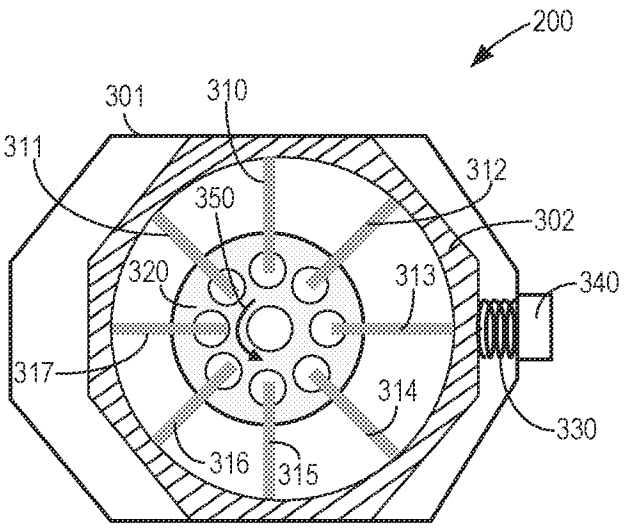
FIG. 3A shows an example variable oil pump (VOP) in a high displacement mode.
Figure 4A:
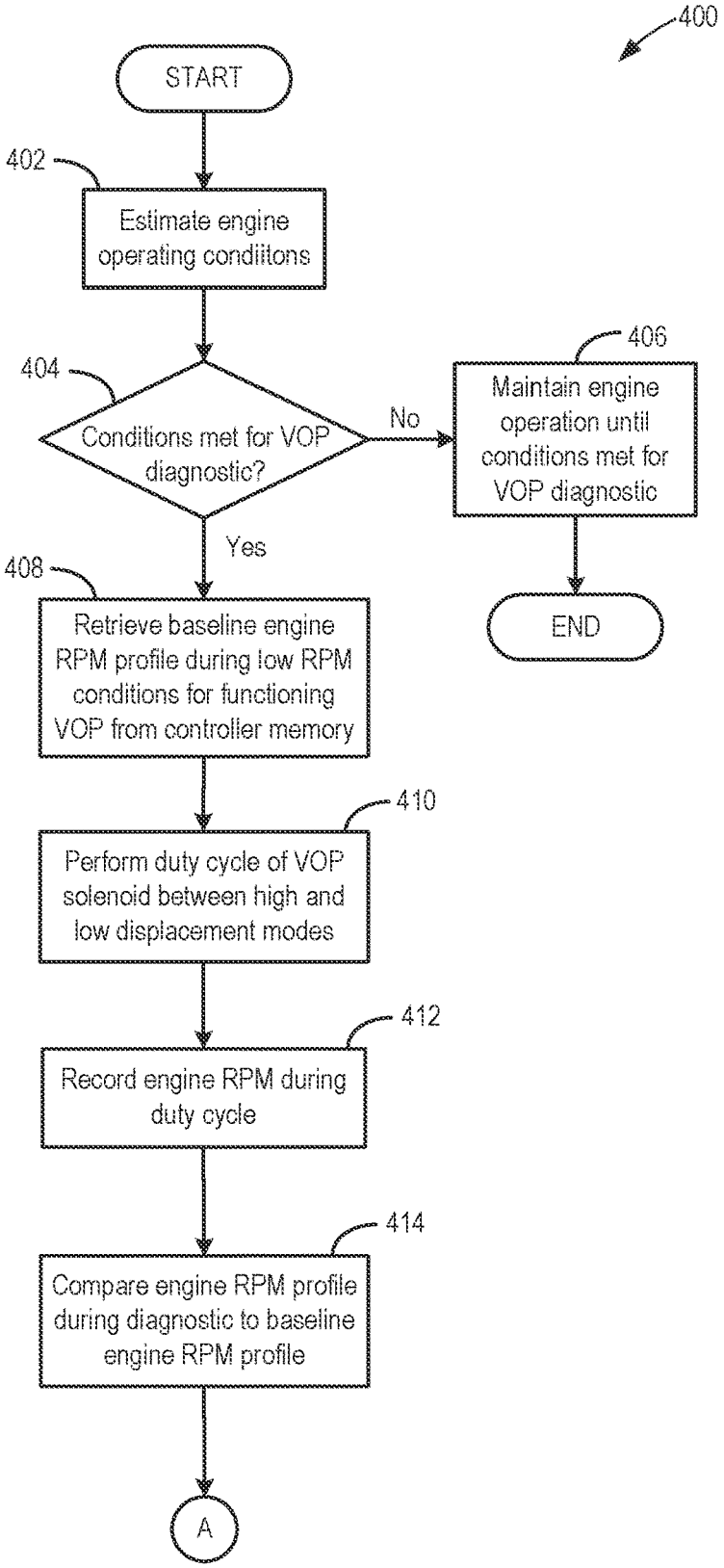
FIGS. 4A-4B show a high level flow chart of an example method for diagnosing the VOP.
Figure 4B:
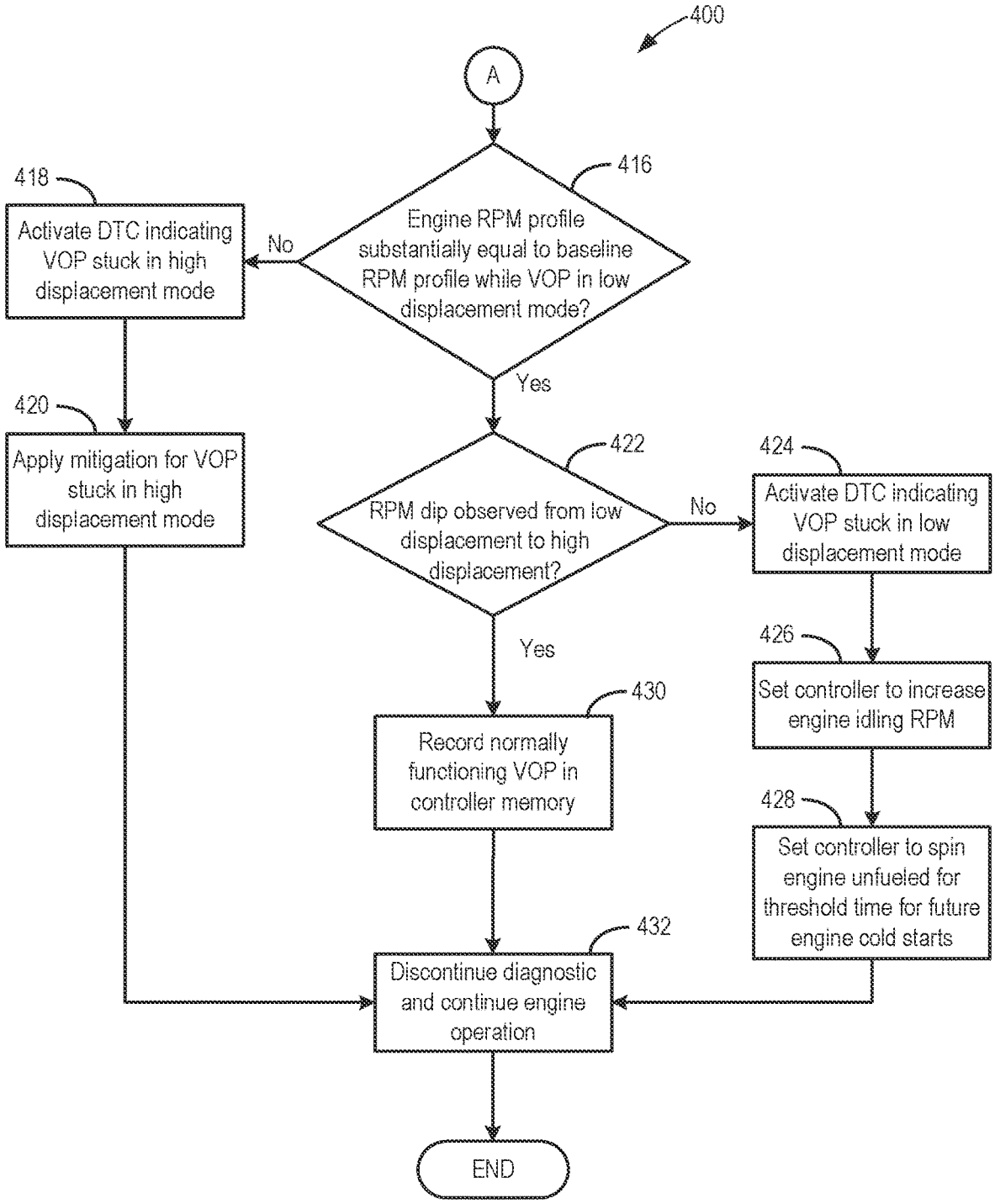
Figure 5:
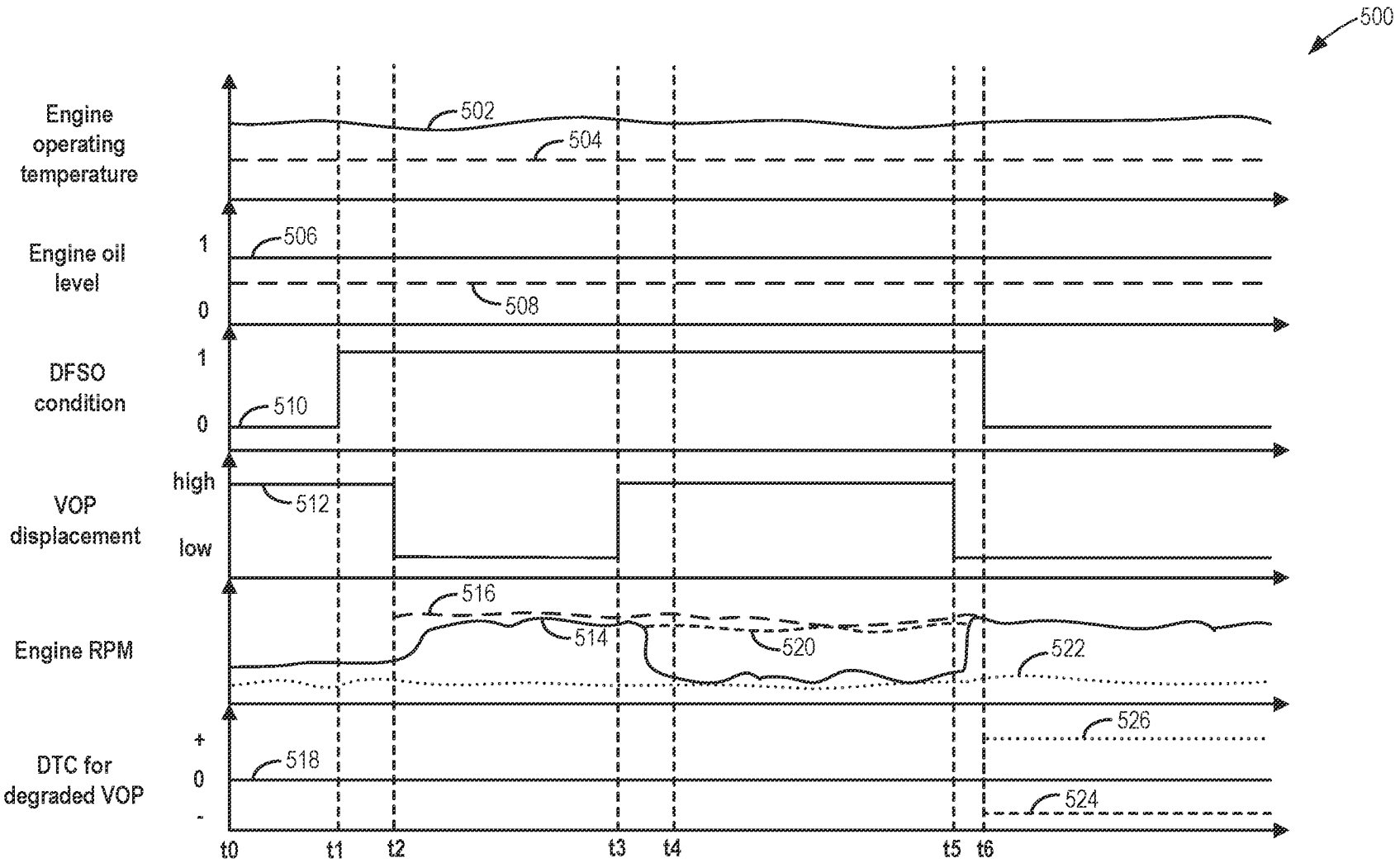
FIG. 5 shows an example timeline for cycling of the VOP between the high displacement mode and the low displacement mode during the DFSO condition for VOP diagnosis.

The following description relates to systems and methods for diagnosing a variable oil pump (VOP) coupled to the crankshaft of a vehicle, such as the vehicle 5 of FIG. 1. The VOP is included in an oil system, such as the oil system of FIG. 2, for supplying engine oil to various moving parts of the engine during engine operation. The VOP may adjust the volumetric oil displacement of the pump by switching between two positions. Examples of the VOP are shown in FIGS. 3A and 3B, wherein the VOP may switch between a high displacement position (as depicted in FIG. 3A) and a low displacement position (as depicted in FIG. 3B) by activating or deactivating a solenoid valve. FIGS. 4A-B show an example method for diagnosing the function of the VOP based on an engine RPM profile during a deceleration fuel shut-off (DFSO) condition. During the DFSO condition, the VOP may be duty cycled between the high displacement mode and the low displacement mode, and changes in the engine RPM profile in response to the operating mode of the VOP may be monitored. If the VOP is stuck in the high displacement mode, a diagnostic trouble code (DTC) may be set indicating the pump is stuck in the high displacement mode; similarly, if the VOP is stuck in the low displacement mode, another DTC may be set indicating the oil pump is stuck in the low displacement mode. In both of the above cases, mitigating actions are taken in response to the diagnosis of the VOP being stuck in either of the low displacement mode or the high displacement mode. FIG. 5 shows an example timeline for duty cycling the VOP between the high displacement mode and the low displacement mode and diagnosing function of the VOP according to the measured engine RPM profile.

Turning now to FIG. 1, an example embodiment of an internal combustion engine 10 of vehicle 5 is shown. Engine 10 may receive control parameters from a control system including controller 12 and input from a vehicle operator 130 via an input device 132. In this example, input device 132 includes an accelerator pedal and a pedal position sensor 134 for generating a proportional pedal position signal PP. Cylinder (herein also "combustion chamber") 14 of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the vehicle system via a transmission system. Crankshaft 140 may be mechanically coupled to a variable oil pump (VOP) 200 of an oil system (such as oil system 20 of FIG. 2) via driving shaft 205. The crankshaft 140 may provide rotary power to operate the VOP 200. The output flow rate of the VOP may be adjusted by adjusting the volumetric oil displacement of the oil pump. The displacement may be controlled by controller 12. One example embodiment of the VOP is shown in FIG. 3.

Cylinder 14 can receive intake air via intake passage 142, induction passage 144, and intake manifold 146. Intake manifold 146 may communicate with other cylinders of engine 10 in addition to cylinder 14. In some embodiments, one or more of the intake passages may include a boosting device such as a turbocharger or a supercharger. For example, FIG. 1 shows engine 10 configured with turbocharger including compressor 174 arranged between intake passage 142 and induction passage 144, and an exhaust turbine 176 arranged between exhaust manifold 148 and emission control device 178. Compressor 174 may be at least partially powered by exhaust turbine 176 via shaft 180 where the boosting device is configured as a turbocharger. Throttle 162 may include a throttle plate 164, and may be provided along an intake passage of the engine for varying the flow rate and/or pressure of intake air provided to the engine cylinders. For example, throttle 162 may be disposed downstream of compressor 174 or alternatively may be provided upstream of compressor 174.

Exhaust manifold 148 may receive exhaust gases from other cylinders of engine 10 in addition to cylinder 14. Exhaust gas sensor 128 is shown coupled to exhaust manifold 148 upstream of emission control device 178, but it will be appreciated that it may be located at other locations in the exhaust system. Exhaust gas sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Each cylinder of engine 10 may include one or more intake valves and one or more exhaust valves. For example, cylinder 14 is shown including at least one poppet-style intake valve 150 and at least one poppet-style exhaust valve 156 located at an upper region of cylinder 14. The intake valve 150 and exhaust valve 156 may be coupled with a camshaft. In some embodiments, each cylinder of engine 10, including cylinder 14, may include at least two intake poppet valves and at least two exhaust poppet valves located at an upper region of the cylinder.

Intake valve 150 may be controlled by controller 12 by cam actuation via cam actuation system 151. Similarly, exhaust valve 156 may be controlled by controller 12 via cam actuation system 153. Cam actuation systems 151 and 153 may each include one or more cams and may utilize one or more of cam profile switching (CPS), variable cam timing (VCT), variable valve timing (VVT), and/or variable valve lift (VVL) systems that may be operated by controller 12 to vary valve operation. Whether electronically actuated or cam actuated, the timing of exhaust and intake valve opening and closure may be adjusted as specified for desired combustion and emissions-control performance. The operation of intake valve 150 and exhaust valve 156 may be determined by valve position sensors (not shown) and/or camshaft position sensors 155 and 157, respectively. In alternative embodiments, the intake and/or exhaust valve may be controlled by electric valve actuation. For example, cylinder 14 may alternatively include an intake valve controlled via electric valve actuation and an exhaust valve controlled via cam actuation including CPS and/or VCT systems. Additionally, a VCT system may include one or more VCT devices (not shown) that may be actuated to adjust the timing of the intake and exhaust valves to a timing that provides decreased positive intake to exhaust valve overlap. That is to say, the intake and exhaust valves will be open for a shorter duration and will move away from being simultaneously open for a portion of the intake stroke. In still other embodiments, the intake and exhaust valves may be controlled by a common valve actuator or actuation system, or a variable valve timing actuator or actuation system.

In some embodiments, each cylinder of engine 10 may include a spark plug 192 for initiating combustion. Ignition system 190 may provide an ignition spark to cylinder 14 via spark plug 192 in response to spark advance signal SA from controller 12, under select operating modes. In other embodiments, compression-ignition engines may use a glow plug in place of spark plug 192.

In some embodiments, each cylinder of engine 10 may be configured with one or more injectors for delivering fuel to the cylinder 14. As a non-limiting example, cylinder 14 is shown including two fuel injectors 170 and 166. Fuel injectors 170 and 166 may be configured to deliver fuel received from fuel system 8 via a high pressure fuel pump and a fuel rail. Alternatively, fuel may be delivered by a single stage fuel pump at lower pressure, in which case the timing of the direct fuel injection may be more limited during the compression stroke than if a high pressure fuel system is used. Further, the fuel tank may have a pressure transducer providing a signal to controller 12.

Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into combustion cylinder 14. While FIG. 1 shows injector 166 positioned to one side of cylinder 14, it may alternatively be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing.

Fuel injector 170 is shown arranged in intake manifold 146, rather than in cylinder 30, in a configuration that provides what is known as port injection of fuel (hereafter referred to as "PFI") into the intake port upstream of cylinder 14. Fuel injector 170 may inject fuel, received from fuel system 8, in proportion to the pulse width of signal FPW-2 received from controller 12 via electronic driver 171. Note that a single electronic driver 168 or 171 may be used for both fuel injection systems, or multiple drivers, for example electronic driver 168 for fuel injector 166 and electronic driver 171 for fuel injector 170, may be used, as depicted.

Fuel may be delivered by both injectors to the cylinder during a single cycle of the cylinder. For example, each injector may deliver a portion of a total fuel injection that is combusted in cylinder 30. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 30.

Controller 12 is shown as a microcomputer, including microprocessor unit 106, input/output ports 108, an electronic storage medium for executable programs and calibration values shown as read-only memory chip 110 in this particular example, random access memory 112, keep alive memory 114, and a data bus. Controller 12 may receive various signals from sensors coupled to engine 10, in addition to those signals previously discussed, including measurement of engine coolant temperature (ECT) from temperature sensor 116 coupled to cooling sleeve 118; a profile ignition pickup signal (PIP) from Hall effect sensor 120 (or other type) coupled to crankshaft 140; throttle position (TPS) from a throttle position sensor; and manifold absolute pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold. Still other sensors may include fuel level sensors and fuel composition sensors coupled to the fuel tank(s) of the fuel system.

Storage medium read-only memory chip 110 can be programmed with computer readable data representing instructions executable by microprocessor unit 106 for performing the methods described below as well as other variants that are anticipated but not specifically listed.

The controller 12 receives signals from the various sensors of FIG. 1 and employs the various actuators of FIG. 1 to adjust engine operation based on the received signals and instructions stored on a memory of the controller. For example, adjusting the mass flow of the VOP include adjusting position of a control chamber of the variable pump by actuating or deactivating a solenoid valve to adjust the displacement of the a spring coupled to the control chamber.

In some examples, vehicle 5 may be a hybrid vehicle with multiple sources of torque available to one or more vehicle wheels 55. In the example shown, vehicle 5 includes engine 10 and an electric machine 52. Electric machine 52 may be a motor or a motor/generator. Crankshaft 140 of engine 10 and electric machine 52 are connected via a transmission 54 to vehicle wheels 55 when one or more clutches 56 are engaged. In the depicted example, a first clutch 56 is provided between crankshaft 140 and electric machine 52, and a second clutch 56 is provided between electric machine 52 and transmission 54. Controller 12 may send a signal to an actuator of each clutch 56 to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power (e.g. draws current) from a battery 58 to provide torque to vehicle wheels 55. Electric machine 52 may also be operated as a generator to provide electrical power to charge battery 58, for example during a braking operation. In one example, the electric machine 52 may draw current from battery 58 and rotate the crankshaft 140 from stop (zero speed) in order to start the engine that is at rest. A sensor may be electrically coupled to the motor and/or the battery for measuring the current flow. The motor may draw current from the battery during cranking, and charge the battery during regenerative braking.

Figure 2:
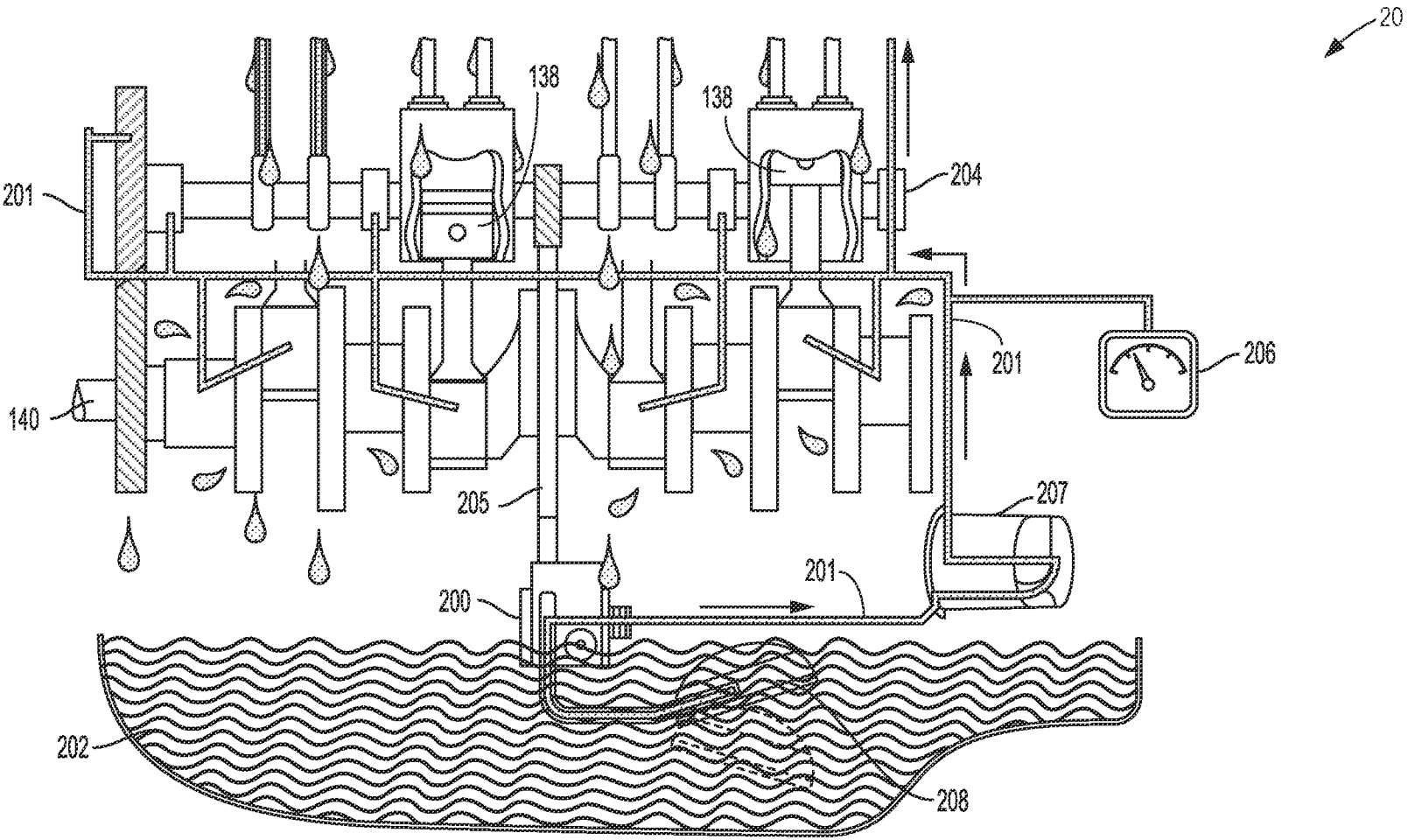
FIG. 2 shows an example oil system for the engine system of FIG. 1.

FIG. 2 shows an example oil system 20 for an engine system (such as the engine 10 of FIG. 1). The oil system 20 may include a variable oil pump (VOP) 200 for supplying engine oil from an oil pan 202 to various engine parts via the oil galleries 201. The various engine parts may include camshaft 204, piston 138, crankshaft 140, and cylinder 14. The VOP 200 may be driven by crankshaft 140 via the driving shaft 205. The rotation speed of the VOP 200 increases as rotation speed of the crankshaft 140 increases. The engine oil enters the VOP 200 from a floating oil intake 208 dispensed in the oil pan 202. The floating oil intake 208 may include a filter 207 for filtering the engine oil. The VOP 200 may be submerged in the engine oil of the oil pan 202. The VOP 200 may pump the engine oil along the oil galleries 201 through filter 207 and oil gauge 206 before releasing the engine oil to the various engine parts. The engine oil may then return back into the oil pan 202 through gravity force.

FIGS. 3A and 3B show an example VOP 200 in the high displacement mode and low displacement mode, respectively. In the high displacement mode of FIG. 3A, the VOP is set to be in the high displacement position. In the low displacement mode of FIG. 3B, the VOP is set to be in the low displacement position. The VOP 200 includes a control chamber 302 that may slide within the working chamber 301 by displacing the spring 330 coupled between the control chamber 302 and the working chamber 301. The spring 330 may be displaced by activating or deactivating the solenoid valve 340. As one example, when the solenoid valve 340 is deactivated, the control chamber 301 is in its default high displacement position, as shown in FIG. 3A. When the solenoid valve 340 is activated, the control chamber 301 is in the low displacement position, as shown in FIG. 3B.

The VOP 200 includes a rotor 320 coupled to the crankshaft (such as crankshaft 140 of FIG. 1) of the engine. Driven by the crankshaft, the rotor may rotate in a direction shown as arrow 350 relative to its central axis. A plurality of sliding vanes (310, 311, 312, 313, 314, 315, 316, and 317) may be coupled to the rotor 320, extending toward and in contact with the inner surface of the control chamber 302. As the control chamber changes its position, the sliding vanes slide relative to the rotor.

At the high displacement position (FIG. 3A), the volumetric oil displacement per revolution of the pump is higher comparing to the pump at the low displacement position (FIG. 3B). In other words, with the same crankshaft rotation speed, the volumetric flow (e.g. $cm^3$/min) of the pump in the high displacement mode is greater than the volumetric flow of the same pump in the low displacement mode. Therefore, by switching from the high displacement mode to the low displacement mode responsive to the engine speed higher than a threshold, the total volumetric flow of the oil supplied to the engine parts may remain the same.

By analyzing engine RPM profiles as the VOP 200 is commanded between a high displacement mode and a low displacement mode, degradation of the VOP may be identified. In particular, in order to diagnose function of the VOP 200, the VOP may be operated in the low displacement mode for a threshold duration during a deceleration fuel shut-off (DFSO) condition, and a first rotations per minute (RPM) profile of the engine may be recorded over the threshold duration in the non-transitory memory of a controller (such as controller 12 of FIG. 1). The VOP may then be switched to operate in the high displacement mode for the threshold duration, and a second RPM profile of the engine may be recorded over the threshold duration in the non-transitory memory of the controller. The VOP 200 may then be indicated to be robust in response to the second RPM profile being lower than the first RPM profile.

In order to indicate a possible degradation of the VOP 200, the baseline RPM profile corresponding to the VOP operation in the low displacement mode may be retrieved from the non-transitory memory of the controller, and the VOP may be indicated to be stuck in the high displacement mode in response to the first RPM profile of the engine being lower than the baseline RPM profile, the baseline RPM profile pre-calibrated for a new VOP during a prior DFSO condition. Additionally, the VOP 200 may be indicated to be stuck in the low displacement mode in response to the second RPM profile being substantially equal to the first RPM profile. In this way, by comparing engine RPM profiles of the engine as the VOP 200 is cycled between the high displacement mode and the low displacement mode during a DFSO condition to each other and to the baseline RPM profile, degradation of the VOP may identified in a robust manner, without relying on oil pressure measurements, which may be affected by extraneous conditions, such as heat rejected to an oil system (such as oil system 20 of FIG. 2). Further details of a method for diagnosis of degradation of the VOP based on a measured engine RPM profile are provided in relation to FIGS. 4A-B.

Turning to FIGS. 4A-B, an example method 400 for diagnosing function of a variable oil pump (VOP) (such as variable oil pump 200 of FIG. 2) is shown. Method 400 will be described in reference to the systems described herein and with regard to FIGS. 1-3B, but it should be understood that similar methods may be applied to other systems without departing from the scope of this disclosure. Method 400 and all other methods described herein may be carried out by a control system (e.g., controller 12 of FIG. 1), and may be stored within controller 12 in non-transitory memory. Instructions for carrying out method 400 and all other method described herein may be executed by the controller in conjunction with signals received from sensors of an engine system of the vehicle, such as the sensors described above with reference to FIG. 1. The controller may employ engine actuators of the engine system to adjust operation of an engine of the vehicle, according to the methods described below.

At 402, method 400 may include estimating engine operating conditions. Estimating engine operating conditions may include the controller acquiring measurements from various sensors in the engine system, including obtaining measurements of engine torque output, engine speed (engine RPM), vehicle speed, atmospheric pressure, ambient temperature, boost pressure, fuel usage, engine oil level, and engine load.

At 404, method 400 may include determining if conditions are met for the diagnostic for the VOP. Conditions for initiating the diagnostic for the VOP may include having an amount of engine oil above a threshold level of engine oil. The threshold level of engine oil may be a pre-calibrated level of oil in order to allow for sufficient oil pressure during engine operation, including during operation of the VOP in the high displacement mode. The level of engine oil may be estimated via an oil gauge (such as oil gauge 206 of FIG. 2). Another condition for initiating the diagnostic for the VOP may include a temperature of the engine being above a threshold temperature. The threshold temperature may be a pre-calibrated temperature below which rotation of the engine may degrade the components therein, due to the increased viscosity of the cold engine oil. Yet another condition for initiating the diagnostic for the VOP may include the vehicle operating in a deceleration fuel shut-off (DFSO) condition. The DFSO condition may include the engine rotating unfueled during a deceleration, such as in order to save on fuel economy, whereby the vehicle is driven solely by inertial momentum. During DFSO fuel is not injected to the engine cylinders and combustion is suspended in the cylinders. The DFSO condition may be determined via fuel usage, and measurement of deceleration from a pedal position sensor (such as pedal position sensor 134 of FIG. 1), as determined in 402.

If any one of the conditions for the VOP diagnostic are not met, at 406, method 400 may include maintaining engine operation until conditions are met for the VOP diagnostic. Fuel may be injected to the engine cylinders and the vehicle may be propelled via engine torque. Following 406, method 400 may end.

If all of the conditions for the VOP diagnostic are met, then at 408, method 400 may include retrieving a baseline RPM profile pre-calibrated during low RPM conditions for a functioning VOP from the non-transitory memory of the controller. The low RPM condition may be chosen as a baseline condition, as it may be a commonly accessed operating condition of the engine based on driving behavior of a vehicle operator, e.g., the vehicle may be driven most commonly in a low RPM condition. The baseline engine RPM profile may be a calibrated RPM profile of an engine operating with the VOP in a low displacement mode and in the low RPM condition during a prior DFSO condition. The low RPM operation of the engine may be defined as the engine operating at an RPM below a threshold RPM. In one example, the threshold RPM may be the RPM of the engine at idle. In another example, low RPM operation of the engine may be defined operation below a maximum pre-calibrated RPM at which the VOP without any degradation may operate in the high displacement mode. As an example, for a new VOP, during operation of the engine in the low RPM condition, the baseline RPM profile may be a pre-calibrated over a first threshold duration. In one example, the first threshold duration may be determined by an expected duration of the DFSO condition. The baseline RPM profile may be stored as a time series in the non-transitory memory of the controller in the form of a lookup table, and may depend on several input parameters, such as initial engine RPM, engine temperature, and engine load, among others. As one example, the engine temperatures, initial RPMs, engine loads, and corresponding calibrated baseline RPM profiles may be stored in a lookup table. In another example, the baseline RPM may be defined by a mathematical function, such as a function of time, engine temperature, initial RPMs, and engine loads, and may be stored in the non-transitory memory of the controller. However, other embodiments of lookup tables and/or mathematical functions for the baseline RPM profile may be possible, and the above embodiment may be taken as non-limiting. For example, in some embodiments, there may be a first baseline RPM corresponding to operation of the VOP in the low displacement mode, and a second baseline RPM corresponding to operation of the VOP in the high displacement mode, with each baseline RPM corresponding to time intervals over which the VOP is operating in the low displacement mode or the high displacement mode, respectively. In such embodiments, each of the first baseline RPM and the second baseline RPM may be stored as time series in the non-transitory memory of the controller in the form of a lookup table, and may each depend on several input parameters, such as engine RPM, engine temperature and engine load, among others. Alternatively, in such embodiments may be defined by a mathematical function, such as a function of time, engine temperature, initial RPMs, and engine loads, and may be stored in the non-transitory memory of the controller.

At 410, method 400 may include cycling (e.g., performing a duty cycle) the VOP between a high displacement mode and a low displacement mode. The cycling between the high displacement mode and the low displacement mode during the DFSO condition may occur over the first threshold duration, and may be actuated by the controller. In one embodiment, the cycling may go through one cycle (e.g., low displacement mode to high displacement mode back to low displacement mode, or vice versa). For example, the duty cycle may include cycling the VOP between the low displacement mode and the high displacement mode during the DFSO condition. In other embodiments, the cycling may go through more than one cycle. The number of cycles may depend on the first threshold duration, and the time in each mode of the VOP may be set based on an expected time for the engine RPM to stabilize in response to such changes in the mode of the VOP. The expected time for the engine RPM to stabilize in response to changes in the position of the VOP may be a pre-calibrated duration stored in the non-transitory memory of the controller.

At 412, method 400 may include recording the engine RPM profile during the duty cycle of 410. The engine RPM may be estimated via measurements obtained from a crankshaft position sensor (CPS) (not shown) positioned on a crankshaft (such as crankshaft 140 of FIG. 1) of the engine. The RPM profile may be obtained via measurements from the CPS over the first threshold duration during which the cycling of the VOP between low and high displacement modes occurs, as in 410.

At 414, method 400 may include comparing the engine RPM profile obtained during the duty cycle of 410 to the baseline engine RPM profile retrieved from controller memory in 408. The comparison of the engine RPM profile to the baseline RPM profile may be made over the first threshold duration, whereby values of the engine RPM profile at given times within the first threshold duration may be compared to values of the baseline RPM profile at the same given times. In one embodiment, the comparison of the baseline RPM profile and the engine RPM profile may include computing a mean squared error (MSE) between the baseline RPM profile and the engine RPM profile as a function of time over the first threshold duration. In another embodiment, the comparison of the baseline RPM profile and the engine RPM profile may include computing a mean percentage error (MPE) between the baseline RPM profile and the engine RPM profile as a function of time over the first threshold duration. In particular, a negative MPE between the baseline RPM profile and the engine RPM profile over an interval indicates that the engine RPM profile is less than the baseline RPM profile over the interval.

At 416, method 400 may include determining if the engine RPM profile is substantially equal to the baseline RPM profile while the VOP is commanded to the low displacement mode as part of the duty cycle. For example, the error (e.g., the MPE between the two RPM profiles) may be positive and may be less than or equal to a threshold value (such as within 10%) while the VOP is commanded to the low displacement mode as part of the duty cycle, in order to be considered substantially equal. If the engine RPM profile is substantially equal to the baseline RPM profile while the VOP is commanded to the low displacement mode as part of the duty cycle, then it may indicate either that the VOP is either working properly, or that the VOP is stuck in a low displacement mode. A further test to determine if an RPM change occurs when the VOP is actuated from a low displacement position to a high displacement position may be desirable in order to distinguish between the VOP operating properly and the VOP being stuck in a low displacement mode.

If at 416, it is found that the engine RPM profile is not substantially equal to the baseline RPM profile as the VOP is commanded to the low displacement mode, as determined e.g., by the MPE between the baseline RPM profile and the engine RPM profile being positive and being greater than the threshold value, it may be inferred that the VOP is stuck in the high displacement mode. When the VOP is stuck in a high displacement mode, the engine RPM may be lower than the baseline RPM when the VOP is commanded to the low displacement mode, due to the increased load that the VOP exerts on the engine. In contrast, if the VOP is stuck in the low displacement mode, the engine RPM may be significantly equal (e.g., within less than or equal to 1% MPE) to the baseline RPM while the VOP is commanded to the low displacement mode during the duty cycle. Additionally, if the VOP is functioning without degradation, then the engine RPM profile will deviate from the baseline RPM when the VOP switches from the low displacement mode to the high displacement mode, inducing a dip in the engine RPM due to the increased load on the engine. Following the engine RPM profile being determined to be not substantially equal to the baseline RPM profile and in particular, less than the baseline RPM profile, method 400 may proceed to 418 to activate a diagnostic trouble code (DTC) indicating to the vehicle operator that the VOP is stuck in the high displacement mode. The VOP being stuck in a high displacement mode may result in a reduced fuel economy.

At 420, in response to the VOP being found to be stuck in the high displacement mode, method 400 may include applying mitigation for the pump being stuck in the high displacement position. In one example, mitigation for the VOP being stuck in the high displacement position may include utilizing the electric motor to drive the vehicle, according to a fuel efficiency map programmed into the non-transitory memory of the controller. As one example, in order to mitigate the effects of the VOP being stuck in the high displacement mode during vehicle operation, if the vehicle is a HEV, in response to the VOP being found to be stuck in the high displacement mode, the controller may switch to operating the vehicle in an electric vehicle driving mode (e.g., having torque supplied to the wheels of the vehicle solely through an electric machine, such as electric machine 52 of FIG. 1). In an alternate example in which the vehicle is driven solely through internal combustion via the engine, in response to the VOP being found to be stuck in the high displacement mode and during maximum engine load conditions, the controller may command sources of engine load unrelated to torque production to be reduced and/or switched off, such as commanding off the A/C of the vehicle. Following 420, method 400 may end.

Returning to 416, if it is found that the engine RPM profile is substantially equal to the baseline RPM profile while the VOP is commanded to the low displacement mode, then at 422, method 400 may include determining if a dip in the engine RPM profile when switching from the low displacement mode to the high displacement mode of the VOP during the duty cycle is observed. A dip in the RPM profile during the DFSO condition when the VOP switches from the low displacement mode to the high displacement mode may indicate that the engine is undergoing a higher level of load due to the VOP being in the high displacement mode, thereby reducing the engine RPM. Under conditions in which the engine is operating with fuel (e.g., when the vehicle operator is pressing on the accelerator, or when the vehicle is operating in a cruise control mode), a dip in the RPM due to the VOP switching from the low displacement mode to the high displacement mode may be adjusted, such as by adjusting an opening of an electronic throttle control (ETC). However, during the DFSO mode, since such adjustments may not occur, a dip in the RPM may indicate that the VOP may be functioning without degradation (e.g., without getting stuck in the low displacement mode). In one example, a dip in the RPM of the engine profile may be compared with a threshold change in RPM, the threshold change in RPM being a pre-calibrated percentage change in RPM between the engine RPM when the VOP is operating in a low displacement mode, and the engine RPM when the VOP is operating in a high displacement mode, while the engine is operating in a DFSO condition. As one example, the threshold change in RPM may be an MPE between the baseline RPM profile and the engine RPM profile over the duration of the diagnostic when the VOP is actuated from the low displacement mode to the high displacement mode. In such an example, the threshold change may be greater than or equal to a threshold value (such as 10%) in order to constitute an observed dip in the engine RPM. In alternative embodiments, the engine RPM profile may be compared to each of the first baseline RPM and the second baseline RPM profiles retrieved in 408. In particular, in order to determine if a dip in the engine RPM occurs when the VOP is commanded from the low displacement mode to the high displacement mode, the engine RPM profile when the VOP is commanded from the low displacement position to the high displacement position may be compared to the second baseline RPM profile e.g., by comparing the MPE of the second baseline RPM profile and the engine RPM profile over the interval of the duty cycle where the VOP is commanded to the high displacement condition. The VOP may then be indicated to be robust in response to the second baseline RPM profile being substantially equal (e.g., the MPE being within 1%) to the engine RPM profile over such an interval.

If it is determined that no dip in engine RPM occurs when the VOP is cycled from the low displacement mode to the high displacement mode, or in other words, the engine RPM profile does not decrease from the baseline in response to the VOP being commanded from the low displacement mode to the high displacement mode, it may be inferred that the VOP is stuck in a low displacement mode, and at 424, method 400 may include activating a DTC indicating to the vehicle operator that the VOP is stuck in the low displacement mode. While the VOP is stuck in the low displacement mode, insufficient engine oil may be supplied to the engine and components therein, potentially resulting in premature degradation of engine components due to a lack of lubrication.

In order to mitigate the effect of the VOP being stuck in the low displacement mode, at 426, method 400 may include increasing the engine idling RPM. Increasing the engine idling RPM may force more oil lubrication onto the engine parts, as for a fixed level of opening of the VOP, the volumetric displacement of oil from the VOP may increase with increased crankshaft rotation speed. The increased supply of oil from the VOP co-rotating with the crankshaft may thereby mitigate the reduction in volumetric oil flow from the VOP while it is stuck in the low displacement mode. The increase in RPM during idle may depend on the engine temperature, such that the RPM may increase with decreasing engine temperature. In one example, the engine RPM at idle may be increased at a minimum of 50%, or more, depending on the engine temperature. By raising the engine RPM during an idling condition, overly rapid engine accelerations that may degrade engine operation may be reduced. Rapid increases of the engine RPM may put strain on several components of the engine, including the engine oil, rings of pistons (such as piston 138 of FIG. 1), and cylinders (such as cylinder 14 of FIG. 1). In embodiments of the vehicle where the vehicle is a hybrid vehicle or has start/stop (S/S) capabilities, the vehicle may also force an engine pulldown (e.g., disallow A/C load heating HVAC, and other engine loads) in order to reduce the load on the engine, and protect it from wear due to the reduced volumetric oil flow from the VOP being stuck in the low displacement mode.

At 428, in response to indication that the VOP is stuck in in the low displacement mode, method 400 may include spinning the engine unfueled at a low RPM for a second threshold duration upon a cold start of the engine. During a cold start, the temperature of the engine may be reduced beyond a point where the engine oil may flow smoothly, potentially causing degradation to the engine. Additionally, due to the VOP being stuck in a low displacement mode, insufficient oil may be supplied during the cold start for lubrication. By spinning the engine unfueled at low RPM for the second threshold duration, the engine may become sufficiently lubricated before firing of the cylinders.

The second threshold duration may be an interval calibrated according to engine temperature, over which the VOP may provide a sufficient level of lubrication to the engine. The second threshold duration may increase with decreasing initial engine temperature at cold start. Additionally, the low RPM at which the engine may be rotated may be calibrated in conjunction with the second threshold duration in order to allow have a sufficient level of lubrication upon engine start.

At 432, the diagnostic may be discontinued, and engine operation may continue. Discontinuing of the diagnostic may include discontinuing cycling the VOP between the low displacement mode and the high displacement mode. Additionally, the DFSO condition of the engine may be discontinued. Following 432, method 400 may then end.

Returning to 422, if an engine RPM dip is observed during cycling of the VOP between high and low displacement modes, it may be inferred that the VOP is functioning without any degradation, and then at 430, method 400 may include recording robust VOP. Method 400 may then proceed to 432 to discontinue the diagnostic and continue engine operation, and then may end.

In this way, method 400 may be used to diagnose possible degradation of the VOP of an engine, such as when, during a DFSO condition, operation of the VOP may be switched between the low displacement mode and the high displacement mode, the RPM profile of the engine during operation of the VOP in the low displacement mode and the high displacement mode may be monitored, and the VOP may be indicated to be robust in response to the RPM profile of the engine decreasing upon switching from the operation of the VOP from the low displacement mode to the high displacement mode. Further, the engine RPM profile may be compared to the pre-calibrated baseline RPM of the VOP operating in a low displacement mode, where the VOP may be indicated to be stuck in the high displacement mode in response to the RPM profile of the engine while operating the VOP in the low displacement mode being lower than the baseline, and the VOP may be indicated to be stuck in the low displacement mode in response to the RPM profile of the engine not decreasing from the baseline in response to the VOP being switched from the low displacement mode to the high displacement mode. By monitoring the engine RPM profile when the VOP is commanded between the low displacement mode and the high displacement mode during the DFSO condition, degradation of the VOP may be diagnosed, independently of e.g., multiple sources of heat rejection to the crankcase, and engine cranking issues.

Turning now to FIG. 5, example timeline 500 depicts an example operation of a diagnostic for a variable oil pump (VOP) (such as variable oil pump 200 of FIG. 2) of an engine (such as engine 10 of FIG. 1). The horizontal (x-axis) denotes times and the vertical markers t0-t5 identify significant points during operation of the dual turbocharger system.

The example timeline 500 depicts cycling of the VOP between a high displacement mode and a low displacement mode while the engine is operating in a deceleration fuel shut-off (DFSO) condition. Entry conditions for the diagnostic include an engine oil level being above a threshold level of engine oil, and the temperature of the engine being above a threshold temperature. The threshold level of engine oil may be a pre-calibrated level of oil in order to allow for sufficient oil pressure during engine operation, while the threshold temperature is a threshold below which rotation of the engine may degrade the components therein, due to the increased viscosity of the cold engine oil. The engine operating temperature is shown in plot 502, while the threshold engine temperature is depicted by dashed line 504. The engine oil level is shown in plot 506, and the threshold level of engine oil is depicted by dashed line 508. Upon the vehicle satisfying the above entry conditions and being in the DFSO condition, the diagnostic may begin. The graph of the vehicle operating in the DFSO condition is shown in plot 510. During the diagnostic, the VOP may be actuated between a low displacement position and a high displacement position, whereby the volumetric oil flow from the VOP is low and high, respectively. The displacement of the VOP is shown in plot 512. In response to cycling the VOP between a low displacement position and a high displacement position, the engine RPM may change, due to a difference in the load on the engine between the two positions of the VOP while the engine is operating in the DFSO condition. The engine RPM is depicted in plot 514. If the engine RPM profile drops sufficiently below a baseline RPM profile throughout the diagnostic, it may be inferred that the VOP is stuck in the high displacement position. The baseline RPM profile may be a pre-calibrated profile of the VOP in the low displacement mode over the duration of the diagnostic, and may be retrieved from the non-transitory memory of the controller following initiation of the diagnostic; the baseline RPM profile is depicted by dashed line 516. However, if the deviation of the engine RPM profile from the baseline RPM profile over the duration of the diagnostic is when the VOP is commanded to the high displacement mode is not greater than a threshold value (such as within 10%), the VOP may be inferred to be either functioning without degradation, or may be stuck in a low displacement position. Dashed line 520 shows an example scenario of the engine RPM profile when the VOP is stuck in the low displacement position, while dashed line 522 shows an example scenario of the engine RPM profile when the VOP is stuck in the high displacement position. In response to the VOP being diagnosed as degraded, a diagnostic trouble code (DTC) may alert the vehicle operator of the degradation. Plot 518 shows the DTC, dashed line 524 shows an example scenario of the DTC indicating that the VOP is stuck in the low displacement position, and dashed line 526 shows an example scenario of the DTC indicating that the VOP is stuck in the high displacement position.

Between time t0 and t1, the engine is running in a low RPM condition. The temperature of the engine is above the threshold temperature, and the engine oil level is above the threshold level of engine oil. In response to the engine running in the low RPM condition, the VOP is in a high displacement position, which is the default position during low RPM operation of the engine.

At t1, in response to a decrease in torque demand (e.g., release of the accelerator pedal), the vehicle operating mode is switched to the DFSO condition.

At t2, in response to the entry conditions of the engine temperature being greater than the threshold temperature and the engine oil level being greater than the threshold level of engine oil, in addition to the vehicle being driven in the DFSO condition being satisfied, the VOP diagnostic begins. In response to the beginning of the VOP diagnostic, the VOP is actuated from the high displacement position to the low displacement position. Shortly after t2, in response to the VOP being actuated to the low displacement position, the engine RPM increases, due to the decreased load on the engine. From t2 to t3, the VOP is being operated in the low displacement position, and after the initial increase in engine RPM due to the reduced load on the engine, the RPM of the engine stays relatively constant in response.

At t3, as part of the VOP diagnostic, the VOP is actuated from the low displacement position to the high displacement position. In response to the VOP being actuated from the low displacement position to the high displacement position, from t3 to t4, a dip in the engine RPM occurs. The dip in the engine RPM occurs as a consequence of the increased load on the engine when the VOP switches from the low displacement position to the high displacement position, in the absence of other loads on the engine in the DFSO condition. The dip in the RPM indicates that the VOP is functioning without degradation, and is neither stuck in the low displacement position nor the high displacement position. The dip in the engine RPM is then recorded in the non-transitory memory of a controller (such as controller 12 of FIG. 1).

At t4, the engine RPM begins to stabilize around the lower RPM value of the engine RPM dip. Consequently, from t4 to t5, as the VOP remains actuated to the high displacement position, the engine remains relatively constant.

At t5, the VOP is actuated from the high displacement position to the low displacement position. Consequently, due to the reduced load on the engine when the VOP is in the low displacement position, from t5 to t6, the engine RPM increases to a similar value as was obtained from t2 to t3. From t5 to t6, the engine RPM begins to stabilize around the higher RPM value of the engine RPM dip.

At t6, in response to the dip in the engine RPM recorded in the non-transitory memory of the controller, the VOP is diagnosed as without degradation, and the DTC indicates that there is no degradation. Additionally, the DFSO condition is discontinued (e.g., in response to a request from the vehicle operator), and the method ends.

In an alternate example, as illustrated by dashed line 522, if from t2-t6 the engine RPM profile dropped from the baseline RPM profile beyond a threshold change in RPM, it would have been inferred that the VOP is stuck in a high displacement position, as the VOP being in the high displacement position exerts a greater load on the engine while the engine is running in the DFSO condition, thereby reducing the engine RPM. Consequently, in response to the deviation of the engine RPM profile from the baseline RPM profile not being within the acceptable threshold value of change in RPM, at t6, the DTC would have been set to indicate that the VOP is stuck in the high displacement position, as illustrated by dashed line 526.

In yet another alternate example, as illustrated by dashed line 520, if from t2-t6 the engine RPM profile did not deviate from the baseline RPM profile when the VOP was commanded to a low displacement position, and yet no RPM dip was observed in response to the VOP being actuated from the low displacement position to the high displacement position (such as the observed RPM dip and subsequent increase from t3-t6, as shown in plot 514), it would have been inferred that the VOP was stuck in the low displacement position. Consequently, in response to the engine RPM not undergoing a dip in RPM when the VOP switches from the low displacement position to the high displacement position, at t6, the DTC would have been set to indicate that the VOP is stuck in the low displacement position, as illustrated by dashed line 524.

In this way, by cycling a variable oil pump (VOP) of an engine between a high displacement mode and a low displacement mode during a deceleration fuel shut-off (DFSO) driving condition and monitoring resultant changes in the engine RPM profile, degradation of the VOP may be diagnosed. The technical effect of cycling the VOP between the high displacement mode and the low displacement mode during the DFSO driving condition is that the engine RPM may be responsive to changes in the engine loads due to such cycling. By monitoring the engine RPM for a dip while switching the VOP from the low displacement mode to the high displacement mode, the VOP may be determined to be functioning without degradation. By monitoring the engine RPM being stuck in low RPM (e.g., below a threshold RPM level) during the diagnostic, the VOP may be determined to be stuck in the high displacement mode, and consequently mitigating actions may be taken in order to increase fuel economy. By monitoring the engine RPM being stuck in a high RPM (e.g., no dip RPM dip occurs during the diagnostic) during the diagnostic, the VOP may be determined to be stuck in the low displacement mode, and consequently mitigating actions may be taken in order to reduce engine degradation. By monitoring the engine RPM during the DFSO condition in order to diagnose function of the VOP, reliance on oil pressure measurements, which may be inaccurate due to sources of heat rejected to an oil system (such as oil system 20 of FIG. 2), and/or a degraded oil pressure gauge, may be sidestepped.

The disclosure provides support for a method for an engine, comprising: during a deceleration fuel shut-off (DFSO) condition, diagnosing a variable oil pump (VOP) to be stuck in a displacement mode based on a rotational speed of the engine. In a first example of the method, the diagnosing includes, cycling the VOP between a low displacement mode and a high displacement mode during the DFSO condition, and recording each of a first rotational speed profile corresponding to the low displacement mode and a second rotational speed profile corresponding the high displacement mode. In a second example of the method, optionally including the first example, the method further comprises: retrieving a first baseline corresponding to the VOP operating in the low displacement mode from a controller memory, and comparing the first rotational speed profile to the first baseline. In a third example of the method, optionally including one or both of the first and second examples, the diagnosing further includes, indicating the VOP to be stuck in the high displacement mode in response to the first rotational speed profile being lower than the first baseline. In a fourth example of the method, optionally including one or more or each of the first through third examples, the diagnosing further includes, indicating the VOP to be stuck in the low displacement mode in response to the second rotational speed profile being substantially equal to the first rotational speed profile. In a fifth example of the method, optionally including one or more or each of the first through fourth examples, the method further comprises: retrieving a second baseline corresponding to the VOP operating in the high displacement mode from the controller memory, and comparing the second rotational speed profile to the second baseline. In a sixth example of the method, optionally including one or more or each of the first through fifth examples, the method further comprises: indicating the VOP to be robust in response to the second rotational speed profile being substantially equal to the second baseline. In a seventh example of the method, optionally including one or more or each of the first through sixth examples, each of the first baseline and the second baseline are pre-calibrated by cycling the VOP between the low displacement mode and then high displacement mode during a prior DFSO condition. In an eighth example of the method, optionally including one or more or each of the first through seventh examples, the method further comprises: in response to the VOP being stuck in the high displacement mode, upon the engine reaching a maximum allowable level of torque, commanding off one or more sources of engine load that do not contribute to torque production of the engine. In a ninth example of the method, optionally including one or more or each of the first through eighth examples, the method further comprises: in response to the VOP being stuck in the low displacement mode, increase engine idling speed during subsequent engine operation.

The disclosure also provides support for a method for an engine comprising: switching operation of a variable oil pump (VOP) between a low displacement mode and a high displacement mode, monitoring a rotations per minute (RPM) profile of the engine during operation of the VOP in the low displacement mode and the high displacement mode, and indicating the VOP to be robust in response to the RPM profile of the engine decreasing upon switching from the operation of the VOP from the low displacement mode to the high displacement mode. In a first example of the method, the switching of the VOP between the low displacement mode and the high displacement mode is carried out during a deceleration fuel shut-off (DFSO) condition when an engine temperature is higher than a threshold temperature. In a second example of the method, optionally including the first example, the method further comprises: retrieving, from a memory of a controller of the engine, a baseline corresponding to the VOP operating in the low displacement mode pre-calibrated during a prior DFSO condition. In a third example of the method, optionally including one or both of the first and second examples, the method further comprises: indicating the VOP to be stuck in the high displacement mode in response to the RPM profile of the engine while operating the VOP in the low displacement mode being lower than the baseline. In a fourth example of the method, optionally including one or more or each of the first through third examples, the method further comprises: indicating the VOP to be stuck in the low displacement mode in response to the RPM profile of the engine not decreasing from the baseline in response to the VOP being switched from the low displacement mode to the high displacement mode. In a fifth example of the method, optionally including one or more or each of the first through fourth examples, the method further comprises: in response to the indication of the VOP being stuck in the low displacement mode, during a subsequent engine cold-start, rotating the engine un-fueled over a threshold duration. In a sixth example of the method, optionally including one or more or each of the first through fifth examples, the method further comprises: in response to the indication of the VOP being stuck in the low displacement mode, during a subsequent engine start, increasing an idling speed of the engine, the increase in the idling speed increasing with decreasing engine temperature upon engine start.

The disclosure also provides support for a system for an engine comprising: a controller storing instructions in non-transitory memory that, when executed, cause the controller to: during a deceleration fuel shut-off (DFSO) condition, operate a variable oil pump (VOP) in a low displacement mode for a threshold duration, record a first rotations per minute (RPM) profile of the engine over the threshold duration, switch to operate the VOP in a high displacement mode for the threshold duration, record a second RPM profile of the engine over the threshold duration, and indicate the VOP to be robust in response to the second RPM profile being lower than the first RPM profile. In a first example of the system, the controller includes further instructions to: retrieve a baseline RPM profile corresponding to the VOP operation in the low displacement mode, and indicate the VOP to be stuck in the high displacement mode in response to the first RPM profile of the engine being lower than the baseline RPM profile, the baseline RPM profile pre-calibrated for a new VOP during a prior DFSO condition. In a second example of the system, optionally including the first example, the controller includes further instructions to: indicate the VOP to be stuck in the low displacement mode in response to the second RPM profile being substantially equal to the first RPM profile.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an engine, comprising:

during a deceleration fuel shut-off (DFSO) condition, diagnosing a variable oil pump (VOP) to be stuck in a displacement mode based on a rotational speed of the engine; and adjusting operation of the engine in response to the VOP being stuck in a low displacement mode differently than when the VOP is stuck in a high displacement mode.

2. The method of claim 1, wherein the diagnosing includes cycling the VOP between the low displacement mode and the high displacement mode during the DFSO condition, and recording each of a first rotational speed profile corresponding to the low displacement mode and a second rotational speed profile corresponding the high displacement mode.

3. The method of claim 2, further comprising retrieving a first baseline corresponding to the VOP operating in the low displacement mode from a controller memory, and comparing the first rotational speed profile to the first baseline.

4. The method of claim 3, wherein the diagnosing further includes indicating the VOP to be stuck in the high displacement mode in response to the first rotational speed profile being lower than the first baseline.

5. The method of claim 3, wherein the diagnosing further includes indicating the VOP to be stuck in the low displacement mode in response to the second rotational speed profile being substantially equal to the first rotational speed profile.

6. The method of claim 3, further comprising retrieving a second baseline corresponding to the VOP operating in the high displacement mode from the controller memory, and comparing the second rotational speed profile to the second baseline.

7. The method of claim 6, further comprising indicating the VOP to be robust in response to the second rotational speed profile being substantially equal to the second baseline.

8. The method of claim 6, wherein each of the first baseline and the second baseline are pre-calibrated by cycling the VOP between the low displacement mode and then high displacement mode during a prior DFSO condition.

9. The method of claim 4, further comprising, in response to the VOP being stuck in the high displacement mode, upon the engine reaching a maximum allowable level of torque, commanding off one or more sources of engine load that do not contribute to torque production of the engine.

10. The method of claim 5, further comprising, in response to the VOP being stuck in the low displacement mode, increase engine idling speed during subsequent engine operation.

11. A method for an engine, comprising:

switching operation of a variable oil pump (VOP) between a low displacement mode and a high displacement mode;

monitoring a rotations per minute (RPM) profile of the engine during operation of the VOP in the low displacement mode and the high displacement mode;

indicating the VOP to be robust in response to the RPM profile of the engine decreasing upon switching from the operation of the VOP from the low displacement mode to the high displacement mode;

retrieving, from a memory of a controller of the engine, a baseline corresponding to the VOP operating in the low displacement mode pre-calibrated during a prior DFSO condition;

indicating the VOP to be stuck in the low displacement mode in response to the RPM profile of the engine not decreasing from the baseline in response to the VOP being switched from the low displacement mode to the high displacement mode; and rotating the engine un-fueled over a threshold duration during a subsequent engine cold-start in response to the VOP being stuck in the low displacement mode.

12. The method of claim 11, wherein the switching of the VOP between the low displacement mode and the high displacement mode is carried out during a deceleration fuel shut-off (DFSO) condition when an engine temperature is higher than a threshold temperature.

13. The method of claim 11, further comprising indicating the VOP to be stuck in the high displacement mode in response to the RPM profile of the engine while operating the VOP in the low displacement mode being lower than the baseline.

14. The method of claim 11, further comprising, in response to the indication of the VOP being stuck in the low displacement mode, during a subsequent engine start, increasing an idling speed of the engine, the increase in the idling speed increasing with decreasing engine temperature upon engine start.

15. A system for an engine, comprising:

a controller storing instructions in non-transitory memory that, when executed, cause the controller to:

during a deceleration fuel shut-off (DFSO) condition, operate a variable oil pump (VOP) in a low displacement mode for a threshold duration;

record a first rotations per minute (RPM) profile of the engine over the threshold duration;

switch to operate the VOP in a high displacement mode for the threshold duration, record a second RPM profile of the engine over the threshold duration;

indicate the VOP to be robust in response to the second RPM profile being lower than the first RPM profile;

retrieve a baseline RPM profile corresponding to the VOP operation in the low displacement mode, and indicate the VOP to be stuck in the high displacement mode in response to the first RPM profile of the engine being lower than the baseline RPM profile, the baseline RPM profile pre-calibrated for a new VOP during a prior DFSO condition; and command off one or more sources of engine load that do not contribute to torque production of the engine upon the engine reaching a maximum allowable level of torque.

16. The system of claim 15, wherein the controller includes further instructions to:

retrieve a baseline RPM profile corresponding to the VOP operation in the low displacement mode, and indicate the VOP to be stuck in the high displacement mode in response to the first RPM profile of the engine being lower than the baseline RPM profile, the baseline RPM profile pre-calibrated for a new VOP during a prior DFSO condition.

17. The system of claim 15, wherein the controller includes further instructions to: indicate the VOP to be stuck in the low displacement mode in response to the second RPM profile being substantially equal to the first RPM profile.

* * * * *